US011108166B2

(12) United States Patent
Kaushal et al.

(10) Patent No.: US 11,108,166 B2
(45) Date of Patent: Aug. 31, 2021

(54) ANTENNA DEVICE

(71) Applicant: Fujikura Ltd., Tokyo (JP)

(72) Inventors: Shailendra Kaushal, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 16/643,913

(22) PCT Filed: Sep. 12, 2018

(86) PCT No.: PCT/JP2018/033784
§ 371 (c)(1),
(2) Date: Mar. 3, 2020

(87) PCT Pub. No.: WO2019/059062
PCT Pub. Date: Mar. 28, 2019

(65) Prior Publication Data

US 2020/0212595 A1 Jul. 2, 2020

(30) Foreign Application Priority Data

Sep. 21, 2017 (JP) ..... JP2017-181339

(51) Int. Cl.
*H01Q 1/36* (2006.01)
*H01Q 21/06* (2006.01)
(Continued)

(52) U.S. Cl.
CPC ..... *H01Q 21/065* (2013.01); *H01Q 1/48* (2013.01); *H01Q 5/335* (2015.01); *H01Q 5/371* (2015.01)

(58) Field of Classification Search
CPC ..... H01Q 21/065; H01Q 5/335; H01Q 5/371; H01Q 1/48; H01Q 1/50; H01Q 13/08;
(Continued)

(56) References Cited

U.S. PATENT DOCUMENTS 9,172,135 B2 * 10/2015 Sudo ..... H01Q 19/005
10,886,621 B2 * 1/2021 Tanaka ..... H01Q 13/10
(Continued)

FOREIGN PATENT DOCUMENTS

JP H03-055904 A 3/1991
JP 3-101507 A 4/1991
(Continued)

OTHER PUBLICATIONS

International Search Report dated Nov. 13, 2018, issued in counterpart application No. PCT/JP2018/033784 (2 pages).
(Continued)

*Primary Examiner* — Jean B Jeanglaude
(74) *Attorney, Agent, or Firm* — Westerman, Hattori, Daniels & Adrian, LLP

(57) ABSTRACT

Patch antennas include four radiation elements arrayed in a rectangular lattice pattern at four positions around a feeding point in the electrode, and wiring which electrically couples each of the radiation elements and the feeding point with an equal wiring length, and is fed by a line-shaped feeding conductor arranged at a position intersecting slots formed at a ground conductor plate, where the feeding conductor has a repetitive branch pattern in which multiple pieces of line-shaped wiring are connected in T-shapes being perpendicular to each other at a total of $2^N-1$ branch points from a base end to each of the tips, and each of the tips is bent in a same direction in the second direction from a terminal end of the line-shaped wiring to which the tip is connected.

5 Claims, 8 Drawing Sheets

(51) Int. Cl.
*H01Q 5/335* (2015.01)
*H01Q 5/371* (2015.01)
*H01Q 1/48* (2006.01)

(58) Field of Classification Search
CPC ... H01Q 21/06; H01P 5/02; H01P 5/08; H01P 5/12
USPC ..... 343/848
See application file for complete search history.

(56) References Cited

U.S. PATENT DOCUMENTS

| | | | | |
|---|---|---|---|---|
| 10,892,554 | B2 * | 1/2021 | Yamada | H01Q 5/35 |
| 10,944,181 | B2 * | 3/2021 | Takayama | H01Q 21/065 |
| 2009/0128435 | A1 | 5/2009 | Jeng | |
| 2011/0122041 | A1 * | 5/2011 | Morishita | H01Q 9/0414 343/846 |
| 2012/0229343 | A1 * | 9/2012 | Sudo | H01Q 19/28 343/700 MS |
| 2012/0229356 | A1 * | 9/2012 | Sudo | H01Q 21/06 343/834 |
| 2014/0368397 | A1 * | 12/2014 | Onaka | H01Q 19/185 343/837 |
| 2015/0318621 | A1 | 11/2015 | Apostolos et al. | |
| 2016/0380362 | A1 | 12/2016 | Cheng et al. | |
| 2019/0288399 | A1 * | 9/2019 | Tanaka | H01Q 1/243 |

FOREIGN PATENT DOCUMENTS

| | | | |
|---|---|---|---|
| JP | H05-191132 | A | 7/1993 |
| JP | 11-74717 | A | 3/1999 |
| JP | 11-266118 | A | 9/1999 |
| JP | 2004-200774 | A | 7/2004 |

OTHER PUBLICATIONS

Preetham B Kumar et al.: "Optimization of Microwave T Junction Power Divider Circuits ", Proceedings of the Midwest Symposium On Circuits and Systems. Lafayette, Aug. 3-5, 1994; [Proceedings of the Midwest Symposium On Circuits and Systems], New York, IEEE, US, vol. SYMP. 37, Aug. 3, 1994 (Aug. 3, 1994), pp. 1235-1238, XP000531885, ISBN: 978-0-7803-2429-9; Cited in EP Search Report dated May 11, 2021. (4 pages).

* cited by examiner

ANTENNA DEVICE

TECHNICAL FIELD

The present invention relates to an antenna device.

This application is a National Stage Application filed under 35 U.S.C. § 371 of International Application No. PCT/JP2018/033784 filed on Sep. 12, 2018 which claims the benefit of priority under 35 U.S.C. § 119(a) of Japanese Patent Application No. 2017-181339 filed on Sep. 21, 2017, the contents of which are incorporated herein by reference.

BACKGROUND ART

In the field of high-speed wireless communication, antenna devices including planar antennas of an electromagnetic coupling feeding system are known.

For example, Patent Document 1 describes a phased array antenna device in which a rectangular feeding slot is formed in a feeding slot layer that is a ground layer, and a distribution synthesizer is electromagnetically coupled to circular radiation elements via the feeding slot layer.

In Patent Document 1, the radiation elements are arrayed in a staggered pattern in a plan view, and the branch wiring pattern of the distribution synthesizer pairs two radiation elements adjacent to each other as one set and thereby supplies power simultaneously to the radiation elements.

PRIOR ART DOCUMENTS

Patent Documents

[Patent Document 1]

Japanese Unexamined Patent Application, First Publication No. H11-74717

DISCLOSURE OF INVENTION

Problems to be Solved by the Invention

However, in a case where power is supplied to a large number of radiation elements using a branch wiring pattern as in the technology described in Patent Document 1, the impedance at the feeding source and the impedance at electromagnetic coupling feeding portions with the radiation elements are required to be set at constant values depending on the specifications of the device, such as 50Ω for the feeding source and 120Ω for the electromagnetic coupling feeding portions. It is also necessary to make the line lengths from the feeding source to feeding points correspond in order to make the phase of the electric current in each of the radiation elements correspond.

For this reason, in a case where the feeding wiring is a branch wiring pattern, it is necessary to first match the impedance at branch points. It is further necessary that the branch wiring pattern be laid out so that the line lengths match.

For this reason, the array of radiation elements and the layout design of the branch wiring pattern become complicated, and thus it takes time to design.

Furthermore, if impedance matching at the branch points is insufficient, reflection of a current occurs in the branch wiring pattern, and thus the gain of the antenna device is reduced.

The present invention has been made in view of the above disadvantages, and provides an antenna device that enables efficient design with improved gain.

Means for Solving the Problems

A first aspect of the present invention is an antenna device including: a first dielectric layer; flat-plate-shaped $2^N$ patch antennas where N is an integer greater than or equal to 2 arranged on a first surface of the first dielectric layer, the patch antennas each including an electrode for electromagnetic coupling; a ground conductor plate arranged on a second surface opposite to the first surface of the first dielectric layer, the ground conductor plate formed with slots, which are non-conductive portions, extending in a first direction at positions facing the electrodes; a second dielectric layer secured to the ground conductor plate so as to face the first dielectric layer with the ground conductor plate sandwiched therebetween; and a line-shaped feeding conductor formed on the second dielectric layer so as to face the ground conductor plate with the second dielectric layer sandwiched therebetween, the feeding conductor arranged in a positional relationship intersecting the slots when viewed from a normal direction of the patch antennas with tips extending in a second direction intersecting with the first direction when viewed from the normal direction, in which the patch antennas each further include: four radiation elements arrayed in a rectangular lattice pattern at four positions around a feeding point in the electrode; and wiring which electrically couples each of the radiation elements and the feeding point with an equal wiring length, the feeding conductor has a repetitive branch pattern in which multiple pieces of line-shaped wiring are connected in T-shapes being perpendicular to each other at a total of $2^N-1$ branch points from a base end to each of the tips, and each of the tips is bent in a same direction in the second direction from a terminal end of the line-shaped wiring to which the tip is connected.

According to a second aspect of the present invention, in the antenna device according to the first aspect, an impedance matcher having a line width widened by two or more stages toward a terminal end may be provided at an end of the line-shaped wiring.

According to a third aspect of the present invention, in the antenna device according to the second aspect, a change in impedance at each of the stages of the impedance matcher may be less than or equal to 50Ω.

According to a fourth aspect of the present invention, in the antenna device according to the third aspect, among the impedance matchers, an impedance matcher provided at the base end of the feeding conductor may have less than or equal to 30Ω of a change in impedance at a widening stage closest to the terminal end of the base end.

According to a fifth aspect of the present invention, in the antenna device according to any one of the first to fourth aspects, the second direction may be perpendicular to the first direction, and the tips of the feeding conductor may be perpendicular to the slots when viewed from the normal direction.

Effects of the Invention

According to an antenna device of the present invention, efficient design is enabled with improved gain.

EMBODIMENTS FOR CARRYING OUT THE INVENTION

Hereinafter, an antenna device according to an embodiment of the present it will be described with reference to the drawings.

Figure 1:
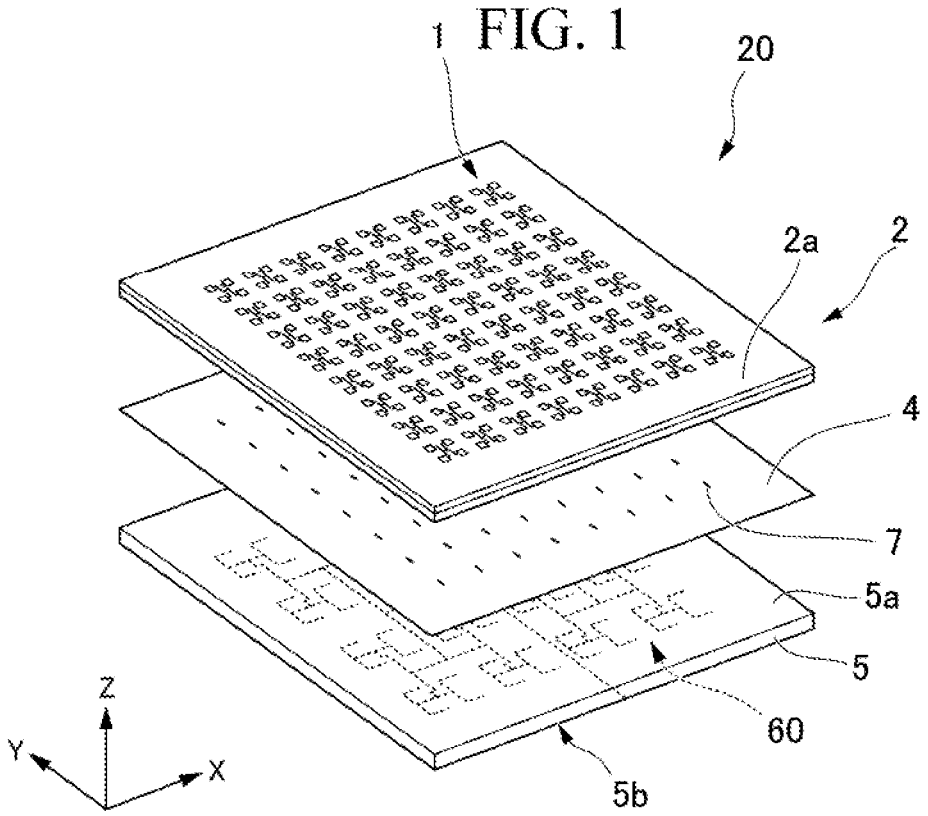
FIG. 1 is a schematic exploded perspective view showing an example of an antenna device of the present embodiment.
Figure 2:
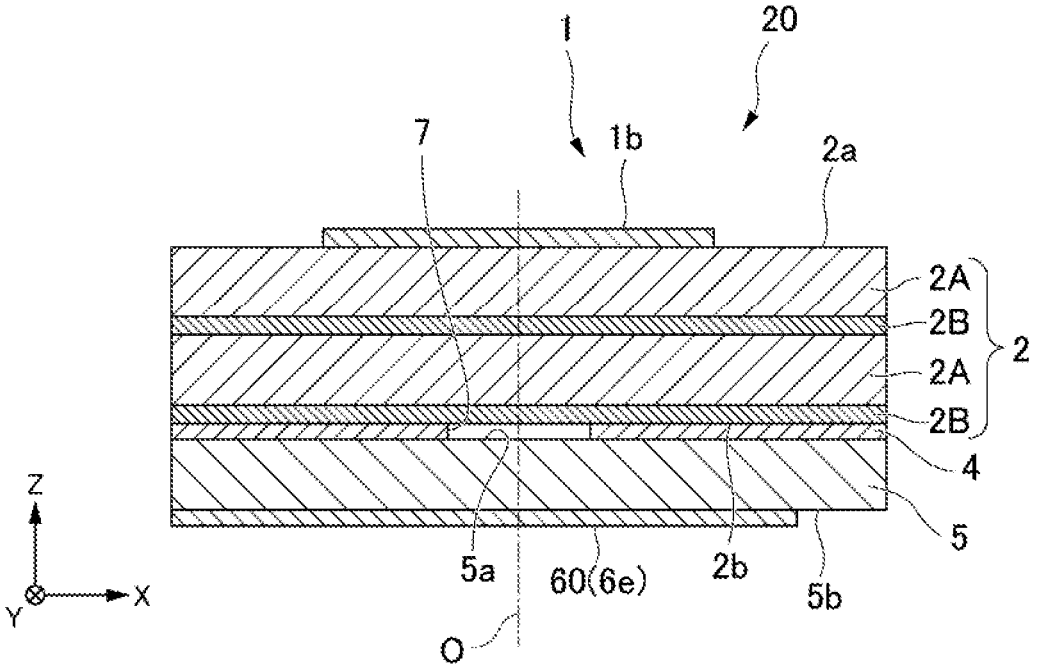
FIG. 2 is a schematic vertical sectional view showing an exemplary example of a configuration of the main part of the antenna device of the present embodiment.
Figure 3:
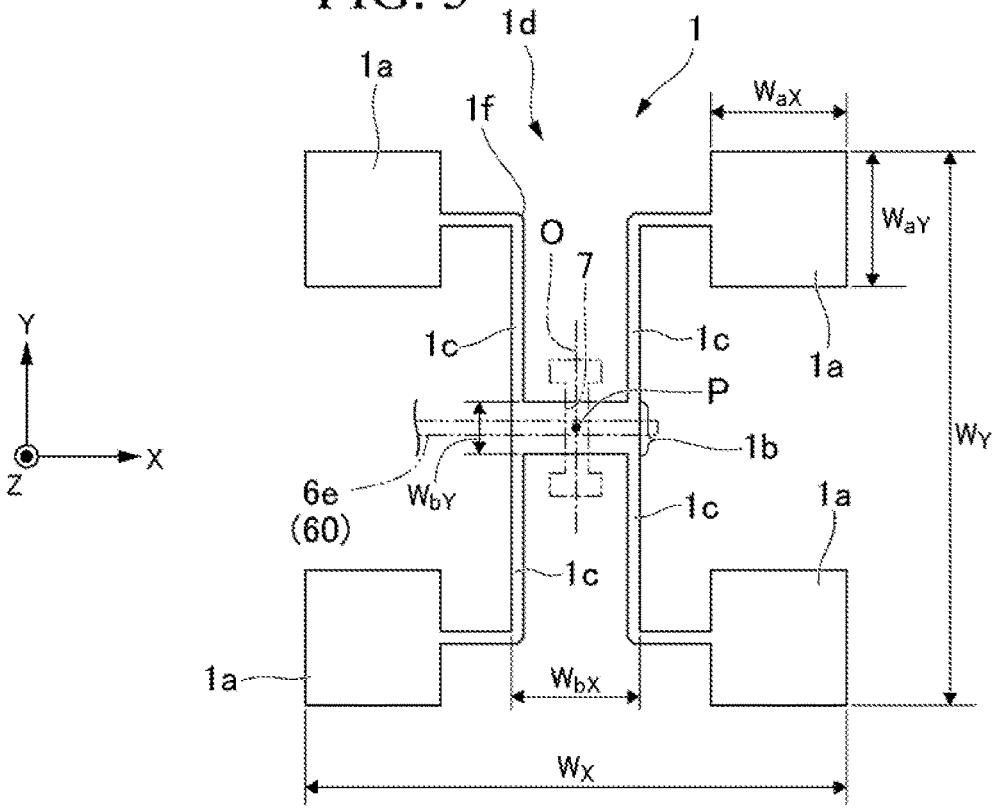
FIG. 3 is a schematic plan view showing an exemplary example of a patch antenna of the antenna device of the present embodiment.
Figure 4:
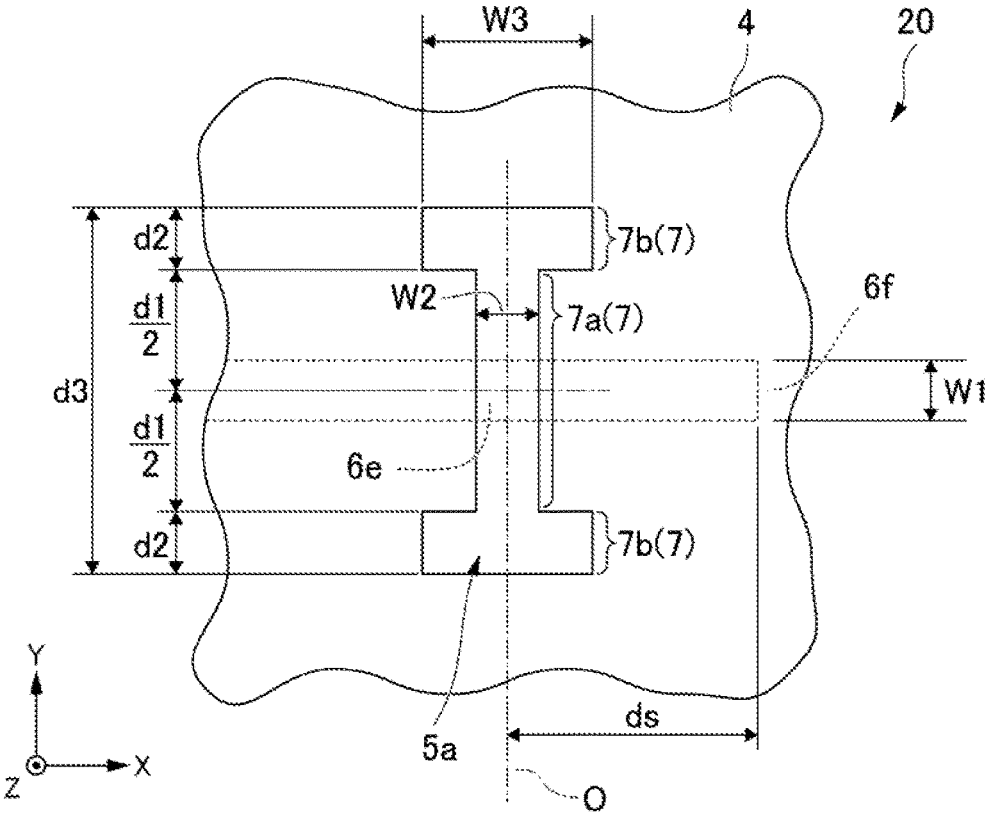
FIG. 4 is a schematic plan view showing an exemplary example of an opening shape of a slot used in the antenna device of the present embodiment.
Figure 5:
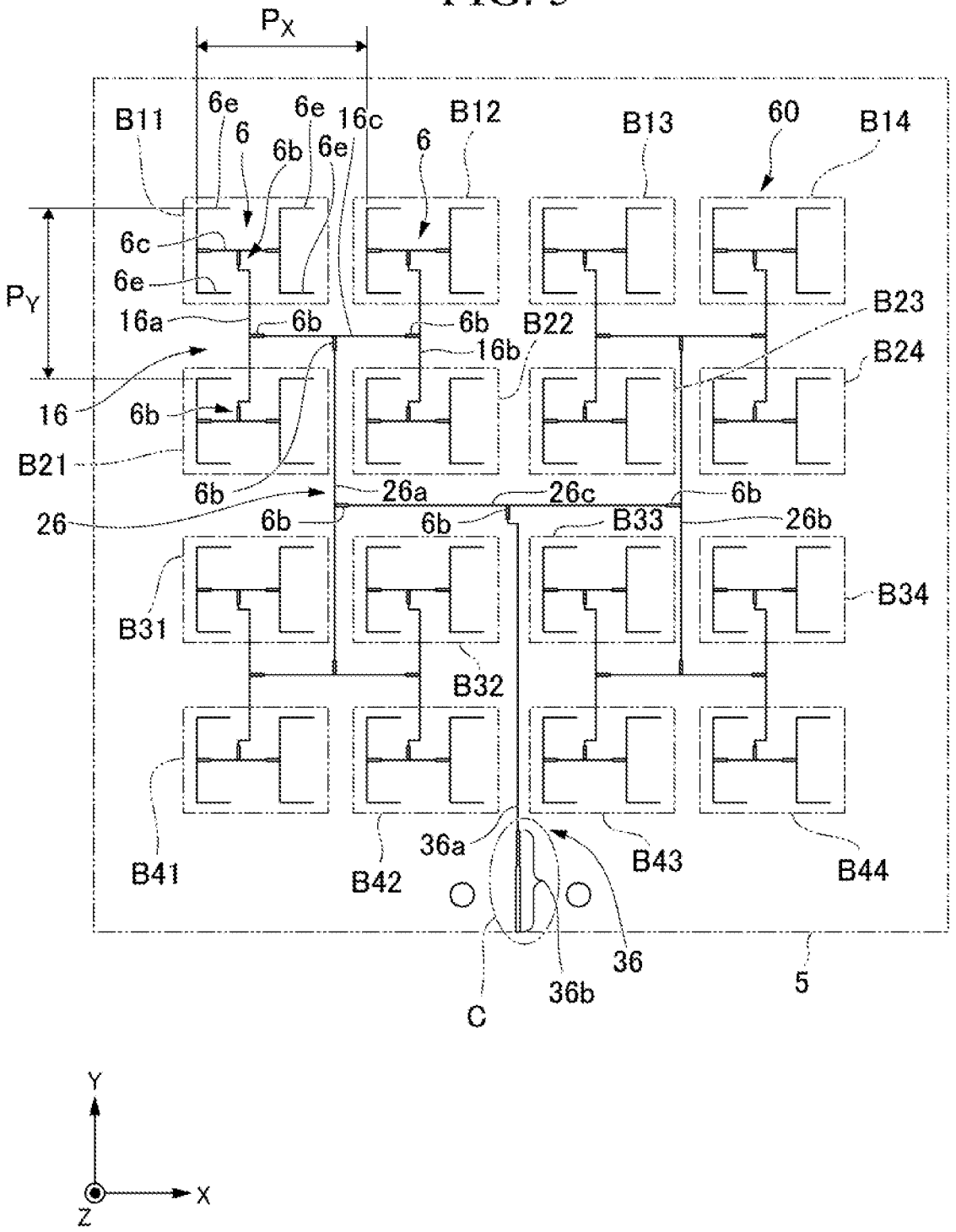
FIG. 5 is a schematic plan view showing an exemplary example of a wiring pattern of a feeding conductor of the antenna device of the present embodiment.
Figure 6:
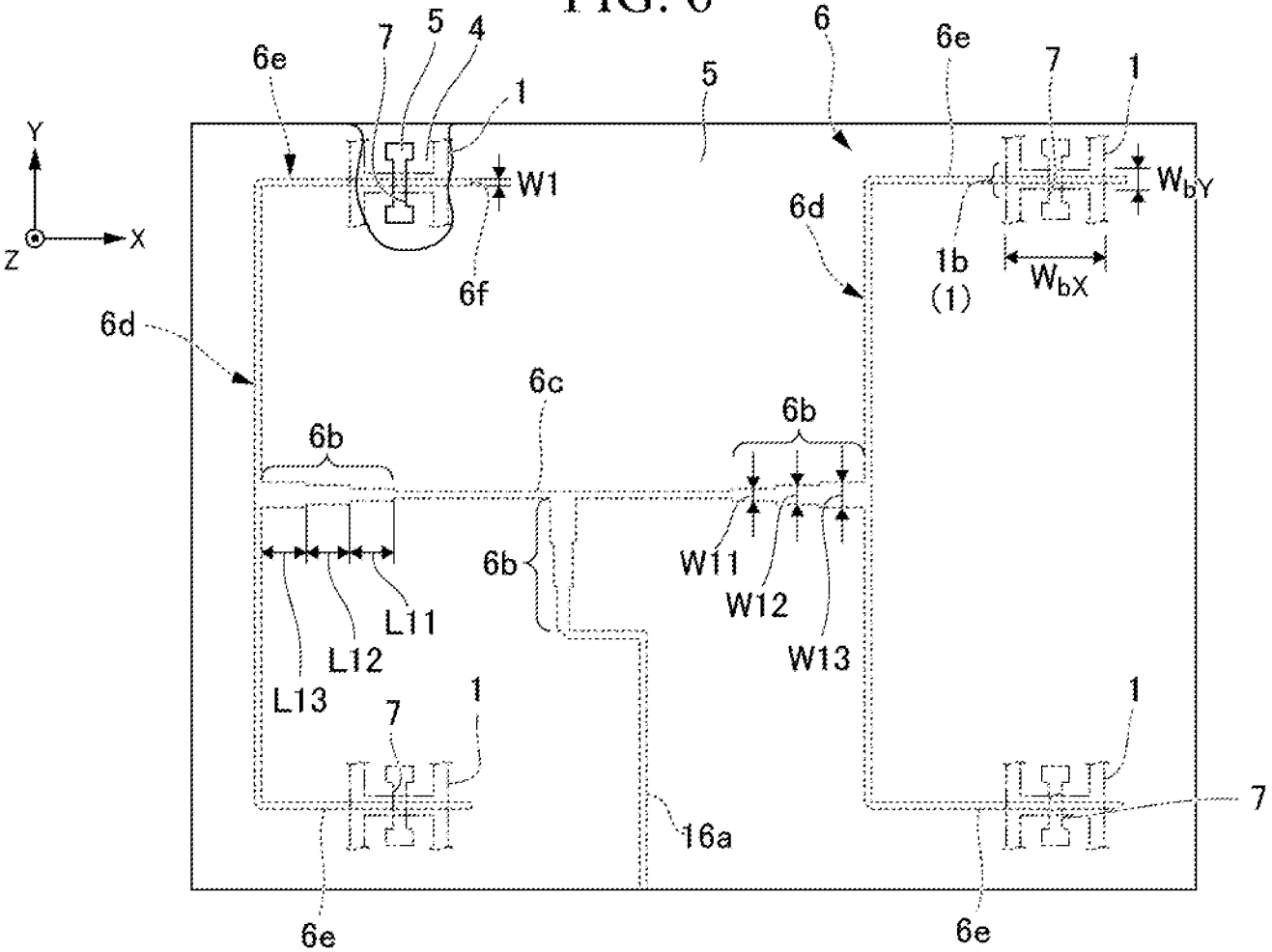
FIG. 6 is a schematic plan view showing an exemplary example of a wiring pattern of the feeding conductor that feeds power to antenna blocks in the antenna device of the present embodiment.
Figure 7:
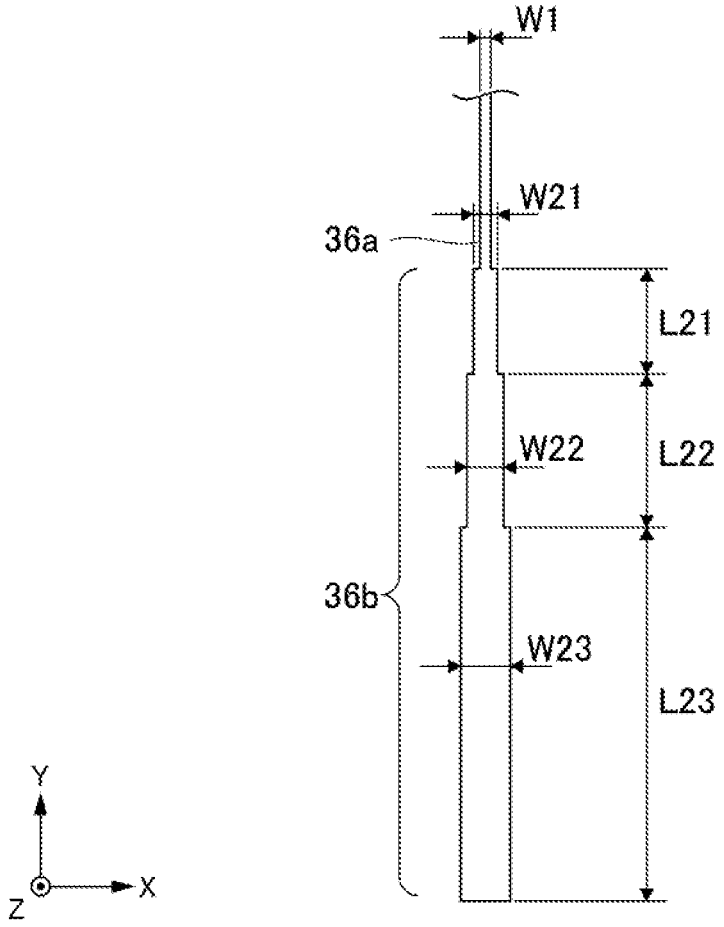
FIG. 7 is a schematic plan view showing an exemplary example of an impedance matcher on the base end side of the feeding conductor in the antenna device of the present embodiment.

FIG. 1 is a schematic exploded perspective view showing an example of an antenna device of the present embodiment. FIG. 2 is a schematic vertical sectional view showing an exemplary example of a configuration of the main part of the antenna device of the present embodiment. FIG. 3 is a schematic plan view showing an exemplary example of a patch antenna of the antenna device of the present embodiment. FIG. 4 is a schematic plan view showing an exemplary example of an opening shape of a slot used in the antenna device of the present embodiment. FIG. 5 is a schematic plan view showing an exemplary example of a wiring pattern of a feeding conductor of the antenna device of the present embodiment. FIG. 6 is a schematic plan view showing an exemplary example of a wiring pattern of the feeding conductor that feeds power to antenna blocks in the antenna device of the present embodiment. FIG. 7 is a schematic plan view showing an exemplary example of an impedance matcher on the base end side of the feeding conductor in the antenna device of the present embodiment.

The drawings are schematic diagrams, in which dimensions or shapes are exaggerated or simplified (the same applies to other drawings below).

An antenna device 20 of the present embodiment shown in FIG. 1 includes planar antennas of an electromagnetic coupling feeding system. For example, the antenna device 20 can be used as an antenna device for communication in the field of internet of things (IoT) or high-speed wireless communication such as wireless gigabit (WiGig).

As shown in FIGS. 1 and 2, the antenna device 20 includes patch antennas 1, a first dielectric layer 2, a ground conductor plate 4, a second dielectric layer 5, and a feeding conductor 60 that are stacked in the order mentioned.

Hereinafter, the stacking direction is defined as a Z-axis direction, and two axial directions perpendicular to the Z-axis direction and perpendicular to each other are referred to as an X-axis direction (second direction) and a Y-axis direction (first direction). The coordinate system here is a right-handed system.

As shown in FIG. 1, the patch antennas 1 are patterned on a first surface 2*a* (first surface) of the first dielectric layer 2 to be described later on the basis of a predetermined array pattern. The normal directions of the patch antennas 1 and the first surface 2*a* are the Z-axis direction.

The patch antennas 1 are planar antennas that are electromagnetically coupled and fed from the feeding conductor 60 which will be described later. In the present embodiment, as an example, a plurality of patch antennas 1 is arrayed in a square lattice pattern arranged in the X-axis direction and the Y-axis direction. Specifically, 64 ($=2^6$) patch antennas 1 are arrayed in an 8×8 square lattice pattern.

As shown in FIG. 3, in the present embodiment, each of the patch antennas 1 includes, as an example, four radiation elements 1*a* and a divided circuit pattern 1*d* which is a divider for arraying the radiation elements 1*a*.

Bach of the radiation elements 1*a* is formed into a square shape having sides each extending in the X-axis direction and the Y-axis direction. The radiation elements 1*a* are arrayed into a rectangular lattice pattern having a substantially square lattice pattern arranged in the X-axis direction and the Y-axis direction.

The divided circuit pattern 1*d* includes an electrode 1*b* for electromagnetic coupling and four pieces of wiring 1*c* for electrically coupling the electrode 1*b* and the radiation elements 1*a* to each other.

The electrode 1*b* is formed into a rectangular shape that extends in the X-axis direction centered at a point P that is an intersection of diagonal lines connecting the centers of the arrangement positions of the radiation elements 1*a*. A feeding point in the electrode 1*b* is formed at the center of the electrode 1*b*.

The wiring 1*c* each extends from a side portion in the Y-axis direction at each of the four corners of the electrode 1*b* toward a radiation element 1*a* to which it is coupled. Specifically, the wiring 1*c* each extends in the Y-axis direction toward a radiation element 1*a* to which it is coupled, and then is bent at a right angle at a position facing the center of the sides in the X-axis direction of the radiation element 1*a* to which it is coupled so as to extend in the X-axis direction. The path lengths of the wiring 1*c* are equal to each other. A chamfered portion 1*f* that intersects with the X axis at 45 degrees is formed at a corner of a bent portion of each piece of the wiring 1*c*.

As shown in FIG. 3, each of the patch antennas 1 having such a configuration is arranged at corners of a rectangular area having a width in the X-axis direction of $W_X$ and a width in the Y-axis direction of $W_Y$.

For example, in application to 60 GHz band wireless communication, $W_X$ and $W_Y$ may be 4.4 mm and 4.52 mm, respectively.

In this case, the width $W_{aX}$ in the X-axis direction and the width $W_{aY}$ in the Y-axis direction of each of the radiation elements 1*a* may be 1.15 mm and 1.15 mm, respectively. The width $W_{bX}$ in the X-axis direction and the width $W_{bY}$ in the Y-axis direction of the electrode 1*b* may be 0.8 mm and 0.4 mm, respectively. The width of each piece of the wiring 1*c* may be 0.13 mm.

The quarter effective length (hereinafter simply referred to as effective length) of such a patch antenna 1 is 1.15 mm, for example.

The patch antennas 1 are made of a metal material such as copper.

In the patch antenna 1, the impedances from the point P to the respective radiation elements 1*a* are set in such a manner that current directions in the respective radiation elements 1*a* become the same. In the present embodiment, the current directions in the respective radiation elements 1*a* as a whole flow in the same direction in the X-axis direction, which is a direction parallel to a tip line 6*e* described later.

As shown in FIGS. 1 and 2, the first dielectric layer 2 is a flat plate member whose dielectric constant and layer thickness are defined depending on required radiation characteristics. The first dielectric layer 2 may be a single-layer dielectric or a plurality of dielectrics bonded together. Whether to use a single layer or a plurality of layers may be determined in consideration of the cost of materials, for example.

In the example shown in FIG. 2, an example is shown in which dielectrics 2A having a certain thickness are joined by resin adhesive layers 2B that are dielectrics. A second surface 2*b* (second surface), which is the surface opposite to the first surface 2*a* in the first dielectric layer 2, is formed by a resin adhesive layer 2B. The resin adhesive layer 2B forming the second surface 2*b* joins the ground conductor plate 4 described later.

In the case where the first dielectric layer 2 includes a plurality of layers as described above, the dielectric constant and the thickness of the first dielectric layer 2 can be easily changed. Thus, it becomes easier to set the impedance of each component to a predetermined value together with the conductor shape of each component in the patch antennas 1.

As shown in FIGS. 1 and 2, the ground conductor plate 4 is a conductor plate-like member in which slots 7 are formed at positions facing the patch antennas 1. The ground conductor plate 4 is grounded.

The ground conductor plate 4 is secured to the first dielectric layer 2 via a resin adhesive layer 2B forming the second surface 2*b*.

The slots 7 are a non-conductive portions in the ground conductor plate 4. As shown in FIGS. 3 and 4, a slot 7 extends in the Y-axis direction which is the first direction. The opening shape of a slot 7 enables impedance matching between the impedance of the patch antenna 1 and the impedance of the feeding conductor 60 described later.

As shown in FIG. 4, a slot 7 in the present embodiment is H-shaped when viewed from the Z-axis direction. Specifically, the slot 7 includes a rectangular first opening 7*a* and second openings 7*b* formed at both ends in the longitudinal direction (first direction) of the first opening 7*a*.

As shown in FIG. 3, the center (centroid) of the slot 7 is arranged so as to overlap with the point P that is the center (centroid) of the electrode 1*b* in the patch antenna 1. Therefore, the slot 7 is orthogonal to the electrode 1*b* at the center of the electrode 1*b* and crosses the electrode 1*b* in the Y-axis direction when viewed from the Z-axis direction.

The first opening 7*a* forms a signal passing portion through which a signal passes. The second openings 7*b* each increase the impedance at both ends of the signal passing portion.

It is more preferable that the length d3 of the slot 7 in the longitudinal direction (first direction) be matched to the effective length of the patch antenna 1.

The first opening 7*a* opens in a rectangular shape having a width of W2 in the X-axis direction (first width) that is the lateral direction (second direction) and a length of d1 (where d1>W2) in the Y-axis direction (first direction) that is the longitudinal direction.

It is more preferable that the width W2 of the first opening 7*a* in the lateral direction be 0.75 mm in order to set the coupling impedance at 112Ω, for example. For example in a case where the impedance of a patch antenna 1 is 220Ω, W2 is more preferably 0.2 mm.

Each of the second openings 7*b* is widened from the width W2 in the lateral direction of the first opening 7*a* in order to form an impedance larger than the coupling impedance by the first opening 7*a*.

In the example shown in FIG. 4, each of the second openings 7*b* opens in a rectangular shape with a length of d2 in the Y-axis direction and a width of W3 in the X-axis direction (where W3>W2).

For example, in the second openings 7*b*, d2 and W3 may be 0.2 mm and 0.4 mm, respectively. In this case, the length d1 of the first opening 7*a* is 0.75 mm (=1.15 mm−2×0.2 mm).

According to the more preferable numerical example of the slot 7 described above, the coupling impedance of the electromagnetic coupling feeding portion is 112Ω at the center of the electrode 1*b*.

As shown in FIG. 2, the second dielectric layer 5 is provided to separate the ground conductor plate 4 and the feeding conductor 60 described later by a certain insulation distance so that electromagnetic coupling feeding can be performed from the feeding conductor 60 described later to the patch antennas 1 through the slots 7.

Therefore, the ground conductor plate 4 is disposed on a first surface 5*a* of the second dielectric layer 5, and the feeding conductor 60 described later is disposed on the second surface 5*b* of the second dielectric layer 5.

In order to improve the feeding efficiency, it is preferable that the relative dielectric constant $\varepsilon_r$ of the second dielectric layer 5 be as small as possible. For example, the relative dielectric constant $\varepsilon_r$ of the second dielectric layer 5 is more preferably within a range of 1 to 2.5.

For example, in the case where the relative dielectric constant $\varepsilon_r$ of the second dielectric layer 5 is 2.2, the thickness of the second dielectric layer 5 is more preferably 130 μm.

As a material of the second dielectric layer 5, quartz glass may be used. In this case, the quartz glass may be bonded to the ground conductor plate 4 by an adhesive sheet that is a dielectric. The thickness of the quartz glass and the adhesive sheet may be set depending on its own relative dielectric constant.

As shown in FIG. 2, the feeding conductor 60 is patterned on the second surface 5*b* of the second dielectric layer 5. The feeding conductor 60 can be electrically coupled to an external circuit (not shown) via a connection path having a predetermined impedance.

As shown in FIG. 5, the feeding conductor 60 includes first block wiring 6, second block wiring 16, third block wiring 26, and base end wiring 36.

First block wiring 6 is a wiring pattern which groups 2×2 patch antennas 1 adjacent to each other in the X-axis direction and the Y-axis direction as one antenna block to form a first feeding block in which power is fed simultaneously to each of the patch antennas 1 in the antenna block.

In the antenna device 20, the patch antennas 1 are arrayed in an 8×8 square lattice pattern, and the patch antennas 1 are divided into blocks Bij (i=1, . . . , 4, j=1, . . . , 4) that are antenna blocks of 2×2 square lattices. Here, the subscript i represents the arrangement order in the Y-axis direction, and an increase of i from 1 means that the arrangement position is shifted in the Y-axis negative direction. The subscript j represents the arrangement order in the X-axis direction, and an increase of j from 1 means that the arrangement position is shifted in the X-axis positive direction. An array pitch $P_X$ in the X-axis direction and an array pitch $P_Y$ in the Y-axis direction of each of the blocks Bij are both 14 mm in the present embodiment.

Thus, four pieces of first block wiring 6 are arrayed at the array pitch $P_X$ in the X axis direction corresponding to the arrangement of the blocks Bij in the X axis direction, and four pieces of first block wiring 6 are arrayed at an array pitch $P_Y$ in the Y axis direction corresponding to the arrangement in the Y axis direction.

Since the configuration of first block wiring 6 in each of the blocks Bij is the same, the example of first block wiring 6 corresponding to a block B11 shown in FIG. 5 will be described.

At tips of the first block wiring 6, four tip lines 6*e* (tips) are formed so as to overlap with four slots 7 and electrodes 1*b* of the four patch antennas 1 corresponding to the block B11 when viewed from the Z-axis direction.

Each of the tip lines 6*e* is a line-shaped conductor forming an open end of the feeding conductor 60. In the present embodiment, each of the tip lines 6*e* extends in the X-axis direction passing through the center in the longitudinal direction of a first opening 7*a* of each of the slots 7 when viewed from the Z-axis direction as shown in FIG. 6. Thus, a tip line 6*e* crosses a first opening 7*a* so as to be perpendicular to a first opening 7*a* when viewed from the Z-axis direction.

The width W1 of the tip lines 6*e* is determined so as to enable manufacturing and to allow back radiation to be minimized since a quite wide line width results in more loss and radiation, whereas a quite thin line width is difficult to manufacture. For example, the width W1 of the tip lines 6*e* may be 0.1 mm.

As shown in FIG. 4, the length (stub length) from a central axis O of the first opening 7*a* to a tip 6*f* of the tip line 6*e* is ds. In the present embodiment, the stub length ds matches the length d1 of the first opening 7*a* in order to match the reactance components. In the numerical example of the slot 7 described above, the stub length ds is 0.75 mm.

As shown in FIG. 6, two tip lines 6*e* adjacent in the Y-axis direction, of the respective tip lines 6*e*, are coupled to each other by a first line 6*d* (line-shaped wiring) extending in the Y-axis direction at the end portions located on the opposite sides to the tips 6*f*. The width of each of the first lines 6*d* is equal to the width W1 of the tip lines 6*e*.

Two first lines 6*d* adjacent in the X-axis direction are coupled to each other by a second line 6*c* (line-shaped wiring) extending in the X-axis direction at a position bisecting the lengths thereof in the longitudinal direction. The width of each second line 6*c* is equal to the width W1 of the tip lines 6*e* except for both ends in the longitudinal direction.

In this manner, a first line 6*d* and the second line 6*c* are coupled in a T-shape being perpendicular to each other. A first line 6*d* is a branch line when viewed from the second line 6*c*, and the midpoint in the longitudinal direction of the first line 6*d* is a branch point. Hereinafter, unless there is a risk of misunderstanding, the "midpoint" of a line refers to the "midpoint in the longitudinal direction" of the line.

At both ends of the second line 6*c*, impedance matchers 6*b* are formed in which the line width gradually increases from W1 from the center of the second line 6*c* toward the branch points.

An impedance matcher 6*b* in the present embodiment performs impedance matching with the second line 6*c* at a branch point of a first line 6*d*.

An impedance matcher 6*b* has a line width that is widened in three stages of W11, W12, and W13 (where W11<W12<W13) from the middle portion to an end portion of the second line 6*c*. The lengths of the respective portions having the line widths W11, W12, and W13 are L11, L12, and L13, respectively.

Specific numerical examples for the impedance matcher 6*b* include 0.12 mm, 0.22 mm, and 0.3 mm for the line widths W11, W12, and W13, respectively. In this case, the impedances of the respective portions having the line widths W11, W12, and W13 are 96Ω, 70Ω, and 58Ω, respectively.

Since the impedance of the main body of the second line (the portion having the width W1 excluding the impedance matchers 6*b* at both ends) is 112Ω and the impedance at the branch points are 56Ω (=112Ω/2), the impedance gradually changes from the main body of second line 6*c* toward the branch points of the first lines 6*d*, such as 112Ω, 96Ω, 70Ω, and 58Ω, and is matched with the impedance 56Ω at the branch points.

In this example, the amounts of change in impedance by an impedance matcher 6*b* are 16Ω, 26Ω, and 12Ω for each portion where the line width changes toward the branch point.

According to an examination result of the inventors, for example in a case where a frequency band used by the antenna device 20 is a 60 GHz band, if the amount of change in impedance in the portions where the line width changes in the impedance matcher 6*b* is less than or equal to 50Ω, a return loss due to a current reflection at a branch point is preferably suppressed. As in the above numerical example, it is more preferable that the amount of change in impedance at portions where the line width changes is less than or equal to 30Ω.

For example, in order to match the impedance of the 112Ω wiring to the impedance at a branch point (56Ω) within a range of amount of change in impedance less than or equal to 30Ω, the number of stages of widening width in an impedance matcher 6*b* is only required to be greater than or equal to two ((112Ω−56Ω)/30Ω=1.86<2). However, if the number of steps is too many, it becomes difficult to form a minute line width difference with high accuracy m manufacturing, and thus it is particularly preferable that the number of stages of widening width be three.

In such first block wiring 6, the lengths of the four lines from the midpoint of the second line 6*c* to the respective feeding points are equal to each other. Therefore, a current flowed into the midpoint of the second line 6*c* is divided into four and thereby distributed to each of the tip lines 6*e*.

Moreover, each of the tip lines 6*e* extends from a first line 6*d* in the X-axis positive direction. Thus, the currents distributed to each of the tip lines 6*e* flow in the same direction in the same phase.

Each of such tip lines 6*e* is impedance-matched with a slot 7 that the tip line 6*e* faces.

As shown in FIG. 5, a second block wiring 16 electrically couples respective pieces of first block wiring 6 in four blocks Bij arranged adjacent to each other in a square lattice pattern. Second block wiring 16 is a substantially H-shaped wiring pattern that groups four blocks of four patch antennas 1 that form a block Bij to form a second feeding block in which power is fed collectively.

Specifically, second block wiring 16 is formed at four locations in similar wiring patterns so as to mutually couple first block wiring 6 corresponding to blocks B11, B12, B21, and B22, and first block wiring 6 corresponding to blocks B13, B14, B23, and B24, first block wiring 6 corresponding to blocks B31, B32, B41, and B42, and first block wiring 6 corresponding to blocks B33, B34, B43, and B44.

Hereinafter, as an example, the structure of the second block wiring 16 that mutually connects the first block wiring 6 corresponding to the blocks B11, B12, B21, and B22 will be described.

The second block wiring 16 includes a first line 16*a* (line-shaped wiring), a second line 16*b* (line-shaped wiring), and a third line 16*c* (line-shaped wiring).

The first line 16*a* electrically couples, in the Y-axis direction, the midpoint of the second line 6*c* of the first block wiring 6 corresponding to the block B11 and the midpoint of the second line 6*c* of the first block wiring 6 corresponding to the block B21.

For example, as shown in FIG. 6, the end of the first line 16*a* coupled to the second line 6*c* of the first block wiring 6 corresponding to the block B11 is bent in the X-axis negative direction, and then is coupled to the second line 6*c* at a position facing the midpoint of the second line 6*c* via an impedance matcher 6*b* extending in the Y-axis direction.

The second line 6*c* is a branch line when viewed from the first line 16*a*, and the midpoint of the second line 6*c* is a branch point.

Although no enlarged view is particularly shown, as shown in FIG. 5, the end of the first line 16*a* coupled to the second line 6*c* of the first block wiring 6 corresponding to the block B21 is similarly structured.

The second line 16*b* electrically couples, in the Y-axis direction, the midpoint of the second line 6*c* of the first block wiring 6 corresponding to the block B12 and the midpoint of the second line 6*c* of the first block wiring 6 corresponding to the block B22.

The shape and arrangement of the second line 16*b* are similar to as those of the first line 16*a* except that the second line 6*c* to be coupled is different.

The third line 16*c* electrically couples the midpoint of the first line 16*a* and the midpoint of the second line 16*b* each via an impedance matcher 6*b*. The third line 16*c* is formed into a straight line extending in the X-axis direction.

The first line 16*a* and the second line 16*b* are branch lines when viewed from the third line 16*c*, and the midpoints of the first line 16*a* and the second line 16*b* are branch points.

In the second block wiring 16, the line width of the main body of the first line 16*a*, the second line 16*b*, and the third line 16*c* excluding the respective impedance matchers 6*b* is W1.

Therefore, at each branch point in the second block wiring 16, impedance matching is performed by the impedance matchers 6*b* like in the first block wiring 6 described above.

In such second block wiring 16, the lengths of the four lines from the midpoint of the third line 16*c* to the branch points of the respective second lines 6*c* are equal to each other. Therefore, a current flowed into the midpoint of the third line 16*c* is divided into four and thereby distributed to each of the first block wiring 6.

As shown in FIG. 5, the third block wiring 26 electrically couples four second power feeding blocks electrically coupled by the second block wiring 16 to each other. The third block wiring 26 is a substantially H-shaped wiring pattern that forms a third feeding block in which power is fed to the four second feeding blocks collectively.

Specifically, the third block wiring 26 is formed in the center of the second dielectric layer 5 so as to couple the second block wiring 16 coupled to each piece of the first block wiring 6 corresponding to the blocks B11, B12, B21, and B22, the second block wiring 16 coupled to each piece of the first block wiring 6 corresponding to the blocks B13, B14, B23, and B24, the second block wiring 16 coupled to each of the first block wiring 6 corresponding to the blocks B31, B32, B41, and B42, and the second block wiring 16 coupled to each of the first block wiring 6 corresponding to the blocks B33, B34, B43, and B44.

The third block wiring 26 includes a first line 26*a* (line-shaped wiring), a second line 26*b* (line-shaped wiring), and a third line 26*c* (line-shaped wiring).

The first line 26*a* electrically couples the midpoint of the third line 16*e* that is interposed between the blocks B11 and B12 and the blocks B21 and B22 and extends in the X-axis direction and the midpoint of the third line 16*c* that is interposed between the blocks B31 and B32 and the blocks B41 and B42 and extends in the X-axis direction, each via an impedance matcher 6*b*. The first line 26*a* is formed into a straight line extending in the Y-axis direction.

Each of the third lines 16*c* coupled to the first line 26*a* is a branch line when viewed from the first line 26*a*, and the midpoints of the third lines 16*e* are branch points.

The second line 26*b* electrically couples the midpoint of the third line 16*c* that is interposed between the blocks B13 and B14 and the blocks B23 and B24 and extends in the X-axis direction and the midpoint of the third line 16*c* that is interposed between the blocks B33 and B34 and the blocks B43 and B44 and extends in the X-axis direction, each via an impedance matcher 6*b*. The second line 26*b* is formed into a straight line extending in the Y-axis direction.

Each of the third lines 16*c* coupled to the second line 26*b* is a branch line when viewed from the second line 26*b*, and the midpoints of the third lines 16*c* are branch points.

The third line 26*c* electrically couples the midpoint of the first line 26*a* and the midpoint of the second line 26*b* each via an impedance matcher 6*b*. The third line 26*c* is formed into a straight line extending in the X-axis direction.

The first line 26*a* and the second line 26*b* are branch lines when viewed from the third line 26*c*, and the midpoints of the first line 26*a* and the second line 26*b* are branch points.

In the third block wiring 26, the line width of the main body of the first line 26*a*, the second line 26*b*, and the third line 26*c* excluding the respective impedance matchers 6*b* is W1.

Therefore, at each branch point in the third block wiring 26, impedance matching is performed by the impedance matchers 6*b* like in the first block wiring 6 described above.

In such third block wiring 26, the lengths of the four lines from the midpoint of the third line 26*c* to the branch points of the respective third lines 16*c* are equal to each other. Therefore, a current flowed into the midpoint of the third line 26*c* is divided into four and thereby distributed to each of the second block wiring 16.

The base end wiring 36 includes a substantially straight base end line 36*a* (line-shaped wiring) extending in the Y-axis direction between the blocks B32 and B42 and the blocks B33 and B43 in order to electrically couple the outside of the antenna device 20 and the third block wiring 26.

The upper end of the base end line 36*a* in the figure is coupled to the third line 26*c* of the third block wiring 26. Specifically, like the end of the first line 16*a*, the upper end of the base end fine 36*a* is bent in the negative X-axis direction and then is coupled to the midpoint of the third line 26*c* via an impedance matcher 6*b* extending in the Y-axis direction.

The third line 26*c* is a branch line when viewed from the base end line 36*a*, and the midpoint of the third line 26*c* is a branch point.

An impedance matcher 36*b* is formed at the lower end of the base end line 36*a* in the figure.

The impedance matcher 36*b* is provided at the base end of the feeding conductor 60 and is a feeding source of the feeding conductor 60. For example, a feeding coaxial cable (not shown) having an impedance of 50Ω is electrically coupled to the impedance matcher 36*b*.

The line width of the main body of the base end line 36*a* excluding the impedance matchers 6*b* and 36*b* is W1 as in the main body of the third line 26*c*.

As shown in FIG. 7, the impedance matcher 36*b* has a line width that is widened in three stages of W21, W22, and W23 (where W21<W22<W23) from the middle portion to the lower end of the base end line 36*a* in the figure. The lengths of the respective portions having the line widths W21, W22, and W23 are L21, L22, and L23, respectively.

According to an examination result of the inventors, for example in a case where a frequency band used by the antenna device 20 is a 60 GHz band, it is more preferable that the amount of change in impedance in the portions where the line width changes in the impedance matcher 36*b* in the base end of the feeding conductor 60 be less than or equal to 50Ω and that the amount of change in impedance in the widening stage closest to the terminal end in the base end be less than or equal to 30Ω. In this case, a return loss due to current reflection at the base end of the feeding conductor 60 is more preferably suppressed.

Specific numerical examples for the impedance matcher 36*b* include 0.18 mm, 0.28 mm, and 0.38 mm for the line widths W21, W22, and W23, respectively. In this case, the impedances of the respective portions having the line widths W21, W22, and W23 are 78Ω, 60Ω, and 50Ω, respectively.

The lengths L21, L22, and L23 in the impedance matcher 36*b* are 1 mm, 2 mm, and 5 mm, respectively.

The impedance matcher 36*b* is widened in three stages like the impedance matcher 6*b*, and the impedance gradually changes from the main body of the base end line 36*a* toward the feeding source in multiple stages such as 112Ω, 78Ω, 60Ω, and 50Ω and is matched with the impedance of the coaxial cable of 50Ω.

In this example, the amounts of change in impedance by the impedance matcher 36*b* are 42Ω, 18Ω, and 10Ω for each of the portions where the line width changes toward the feeding source.

With such a structure, the feeding conductor 60 has a repetitive branch pattern in which the multiple pieces of line-shaped wiring, which are extending along the Y-axis direction that is the first direction or along the X-axis direction that is the second direction, are connected in T-shapes being perpendicular to each other at a total of $2^N-1$ branch points (N=6 in the present embodiment) from the base end (impedance matcher 36*b*) that is the feeding source to connection with each of the tips (tip lines 6*e*). Tracing each of the $2^N$ branched wiring paths extending from the base end wiring 36 to each of the tip lines 6*e*, N branch points are formed on each of the wiring paths in the feeding conductor 60.

The antenna device 20 having such a structure is manufactured in the following manner, for example.

First, a conductor film is formed on each of the first surface 5*a* and the second surface 5*b* of the second dielectric layer 5, and then the ground conductor plate 4 and the feeding conductor 60 are each patterned by etching, for example. Then, the first dielectric layer 2, in which the dielectrics 2A are bonded, is bonded onto the ground conductor plate 4. Thereafter, a conductor film is formed on the first surface 2*a* of the first dielectric layer 2, and the patch antennas 1 are patterned by, for example, etching.

After the patch antennas 1 are patterned on the first dielectric layer 2, the first dielectric layer 2 and the ground conductor plate 4 may be bonded together.

Next, the operation of the antenna device 20 of the present embodiment will be described.

Figure 8A:
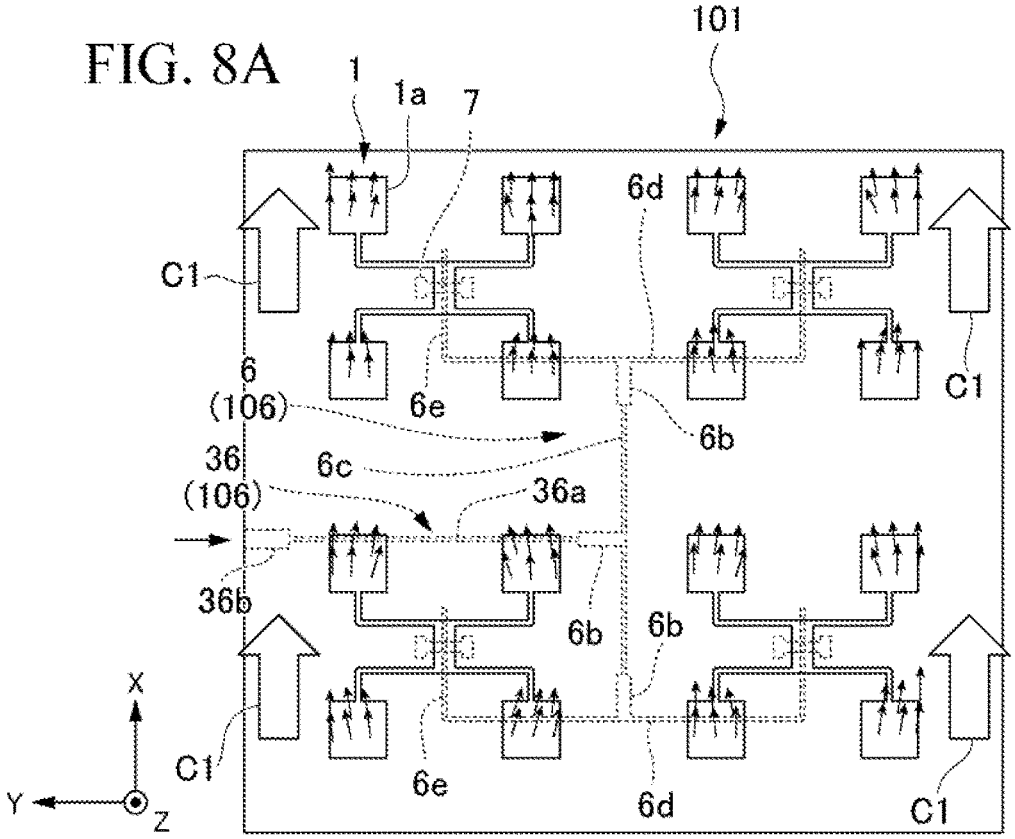
FIG. 8A is a simulation diagram of an example explaining the wiring pattern of the feeding conductor in the antenna device of the present embodiment.
Figure 8B:
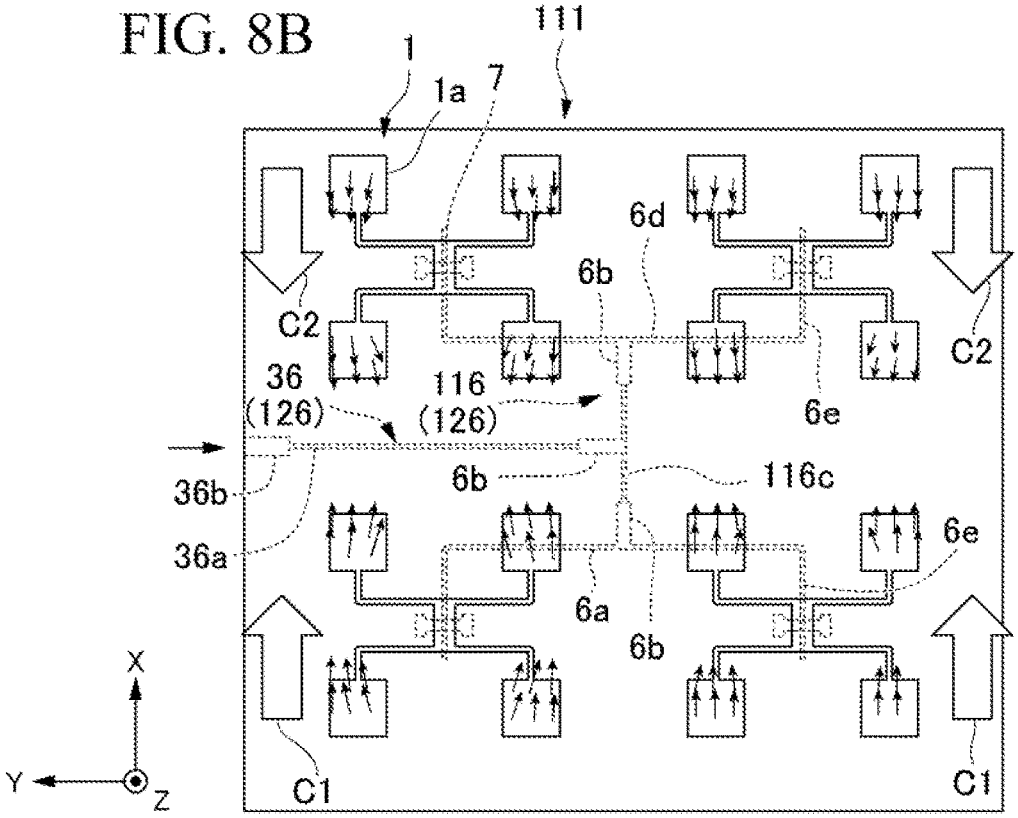
FIG. 8B is a simulation diagram of a comparative example.

FIG. 8A is a simulation diagram of an example explaining the wiring pattern of the feeding conductor in the antenna device of the present embodiment. FIG. 8B is a simulation diagram of a comparative example.

According to the shape of the patch antennas 1 of the present embodiment and the wiring pattern of the feeding conductor 60, when power is fed from the impedance matcher 36*b* of the feeding conductor 60, the current is equally distributed to each of the tip lines 6*e* by the T-shaped branch wiring pattern of the feeding conductor 60.

At this point, since the line lengths from the feeding source to each of the tip lines 6*e* are equal to each other, and the directions of the tips of the tip lines 6*e* are uniformly oriented in the positive X-axis direction in the feeding conductor 60, the electrodes 1*b* of the patch antennas 1 are electromagnetically coupled and fed with the same amount of current of the same phase in the same direction.

It is also necessary that the coupling impedance be matched in the electromagnetic coupling feeding portion from the tip lines 6*e* to the electrodes 1*b* of the patch antennas 1.

In the present embodiment, the coupling impedance is matched through optimization of the arrangement and the opening shape of the first openings 7*a* of the slots 7 in the ground conductor plate 4, formation of the second openings 7*b* in the slots 7, and optimization of ds that is the stub length of the tip lines 6*e*.

In particular, by providing widened second openings 7*b* at both ends of a first opening 7*a*, high-impedance areas are formed outside the both ends of the first opening 7*a*. Therefore, signals efficiently pass through the first opening 7*a*, and thus the reflection loss is reduced as a whole.

A current fed to an electrode 1*b* is equally divided in the same phase and distributed to respective radiation elements 1*a* by a divided circuit pattern 1*d* of a patch antenna 1.

In this manner, in the antenna device 20, a current flows in each of the radiation elements 1*a* in the same phase and in substantially the same direction. For this reason, the gain of a radio wave radiated from each of the patch antennas 1 is improved.

In order to examine such a feeding conductor 60, simulation of the current direction was performed on an example in which the power is directly fed to the midpoints of the second lines 6*c* of the first block wiring 6 and a comparative example in which directions of the tip lines 6*e* are different despite the same line length.

For specific numerical values used in the following numerical simulation, the numerical values exemplified in the above embodiment are used.

In FIG. 8A, the configuration of an antenna device 101 of the example and a simulation result are shown. Note that FIG. 8A is a schematic diagram, and thus the shape is partially simplified.

In the antenna device 101, for example, the 64 patch antennas 1 in the antenna device 20 are replaced with four patch antennas 1, and accordingly, instead of the feeding conductor 60, a feeding conductor 106 including a first block wiring 6 and a base end wiring 36 is included. The other configuration is the same as that of the antenna device 20.

The base end wiring 36 in the antenna device 101 extends in the Y-axis direction and is connected to the midpoint of a second line 6*c*.

In FIG. 8B, a configuration of an antenna device 111 of a comparative example and a simulation result are shown. Note that FIG. 8B is a schematic diagram, and thus the shape is partially simplified.

The antenna device 111 includes a feeding conductor 126 instead of the feeding conductor 106 of the antenna device 101. The feeding conductor 126 includes first block wiring 116 instead of the first block wiring 6 of the feeding conductor 106.

Hereinafter, description will be given focusing on differences from the antenna device 101.

The first block wiring 116 is different from the pattern of the first block wiring 6 in that the first line 6*d* and each of the tip lines 6*e* that feed the two patch antennas 1 in the lower part of the figure are inverted in the X-axis direction and that the inverted first line 6*d* and the first line 6*d* in the upper part of the figure are connected by a second line 116*c* including impedance matchers 6*b* at both ends. The second line 116*c* has a shorter length than that of the second line 6*e*.

The base end wiring 36 in the feeding conductor 126 is formed at a position facing the midpoint of the second line 116*c*, and is translated in the X-axis positive direction from the base end wiring 36 in the feeding conductor 106.

The current flowing in the patch antennas 1 and the radiation pattern were simulated in the case where the antenna devices 101 and 111 having the above configurations are respectively fed from the base end wiring 36.

In the antenna device 101, current directions in the radiation elements 1*a* were aligned in a substantially constant direction (X-axis positive direction in the example shown) as indicated by solid arrows in FIG. 8A. Therefore, in the respective patch antennas 1, the current flowed in substantially the same direction in the patch antennas 1 as a whole as indicated by white arrows C1 in the figure.

On the other hand, in the antenna device 111, as shown in FIG. 8B, although current directions of radiation elements 1*a* of the two patch antennas 1 in the lower part of the figure were similar to those of the antenna device 101, current directions of radiation elements 1*a* of the two patch antennas 1 in the upper part of the figure were opposite to those of the antenna device 101.

In the antenna device 111, as indicated by white arrows C1 and C2 in the figure, the direction of a current flowing through each of the patch antennas 1 as a whole was opposite to the direction of the tip of the tip line 6*e*.

Figure 9A:
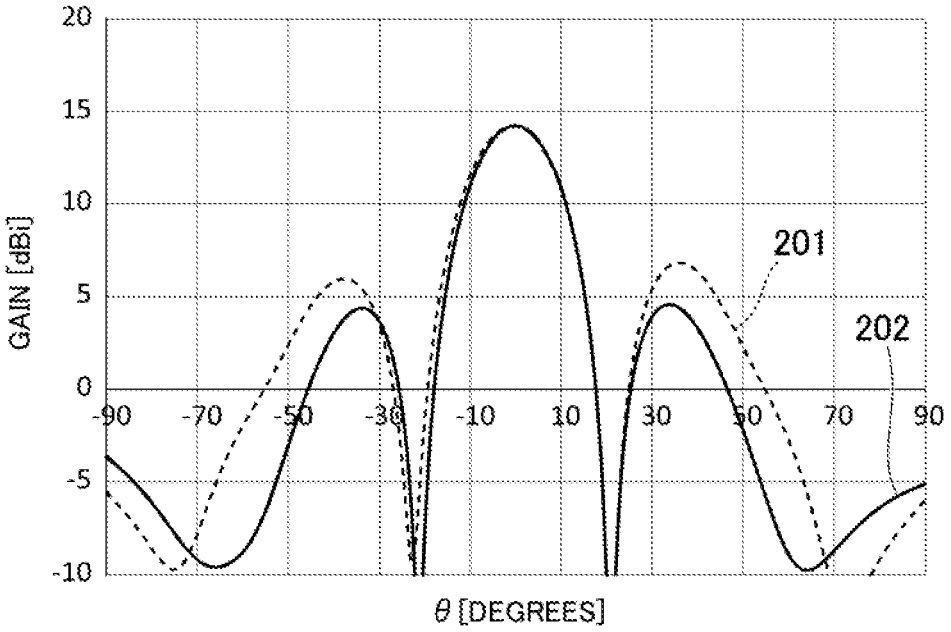
FIG. 9A is a graph showing a radiation pattern of the example.
Figure 9B:
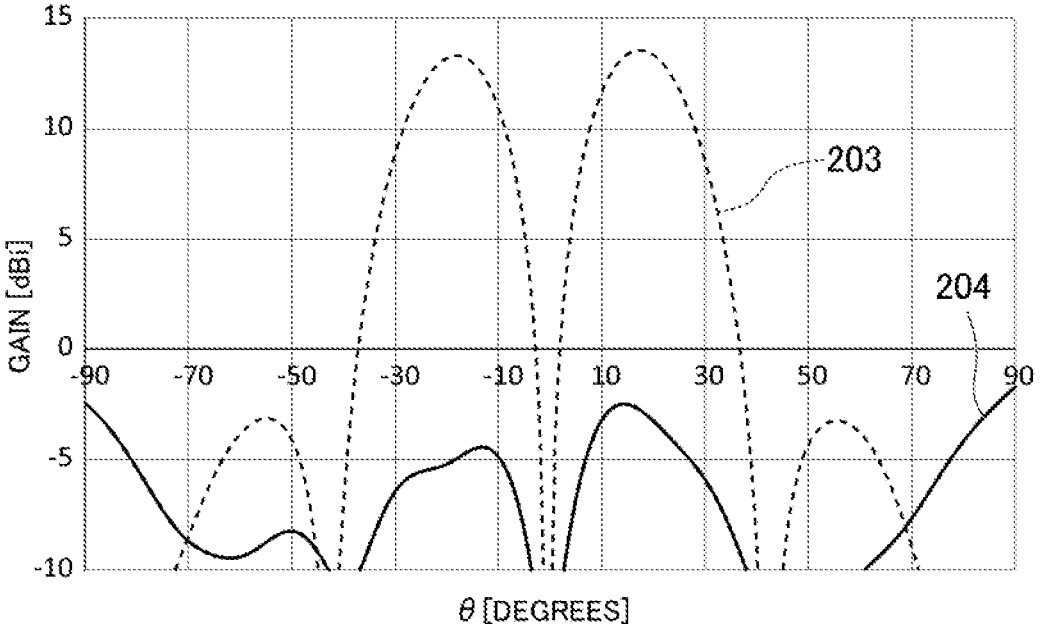
FIG. 9B is a graph showing a radiation pattern of the comparative example.

FIG. 9A is a graph showing the radiation pattern of the example, and FIG. 9B is a graph showing the radiation pattern of the comparative example. In FIGS. 9A and 9B, the horizontal axis represents the elevation angle θ (degrees), and the vertical axis represents the gain (dBi). In FIGS. 9A and 9B, broken lines (curves 201 and 203) represent the total gain on the XZ plane, and solid lines (curves 202 and 204) represent the total gain on the YZ plane. Here, the XZ plane is an electrical plane (E plane), and the YZ plane is a magnetic plane (H plane).

In the antenna device 101 of the example, as shown in FIG. 9A, the radiation pattern on the XZ plane (see the curve 201) and the radiation pattern on the YZ plane (see the curve 202) were substantially the same. At θ=0 (degrees), the gains on the XZ plane and the YZ plane were maximized.

On the other hand, in the antenna device 111 of the comparative example, as shown in FIG. 9B, the radiation pattern on the XZ plane (see the curve 203) is a bimodal radiation pattern having peaks at θ=±18 (degrees), and almost no radio wave was radiated at θ=0 (degrees).

In addition, the gain of the radiation pattern on the YZ plane (see the curve 204) was significantly lower than that of the curve 203. This is considered to be because, since directions of currents flowing through radiation elements 1*a* are opposite in patch antennas 1 facing each other in the X-axis direction, radio waves interfere with each other and cancel each other.

As described above, radiation characteristics of the antenna in the comparative example were significantly inferior to those of the example since the directions of the tip lines 6*e* are not uniform even though the feeding conductor 126 having the T-shaped branch wiring pattern is included.

Next, antenna characteristics of the antenna device 20 will be described.

Figure 10:
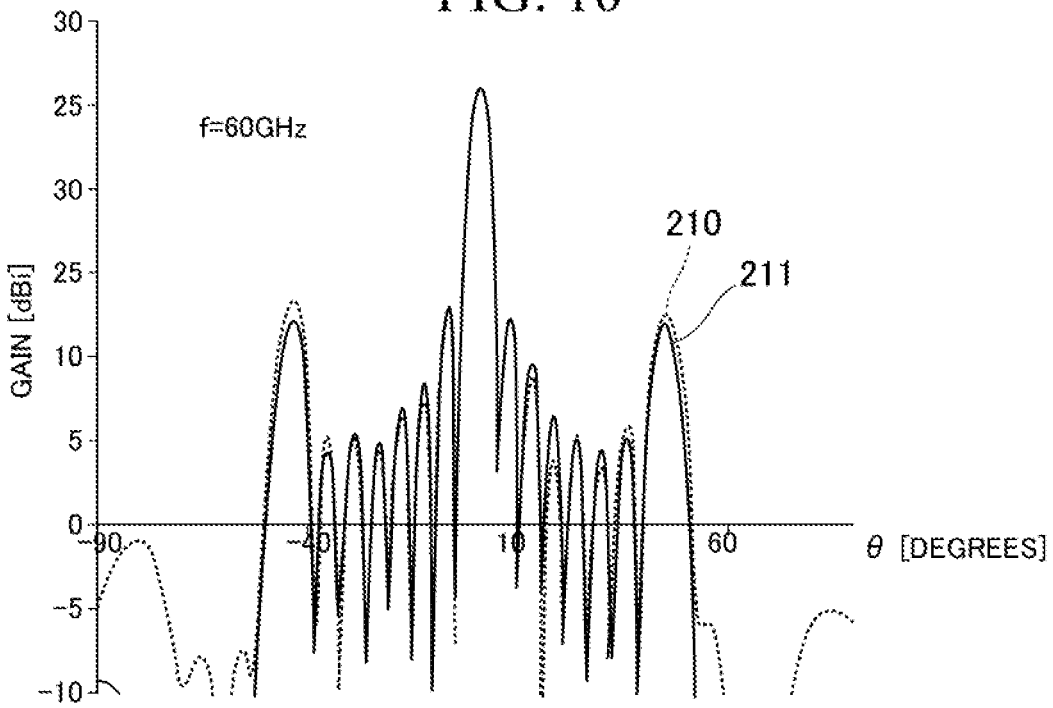
FIG. 10 is a graph showing the total gain in the antenna device of the present embodiment.
Figure 11:
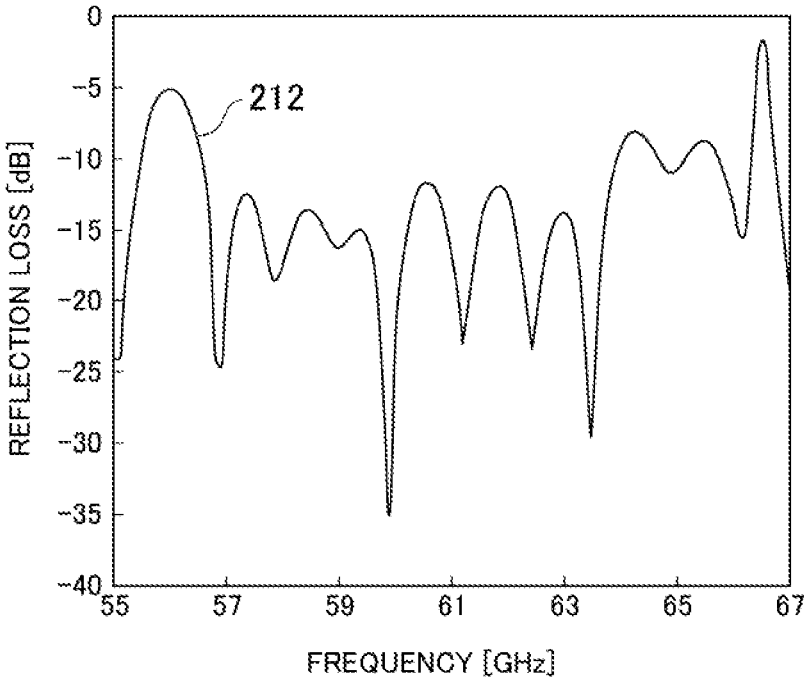
FIG. 11 is a graph showing a reflection loss (S11) in the antenna device of the present embodiment.

FIG. 10 is a graph showing the total gain in the antenna device of the present embodiment. FIG. 11 is a graph showing a reflection loss (S11) in the antenna device of the present embodiment.

In FIG. 10, simulation results of all gains on the XZ plane and the YZ plane are shown.

In FIG. 10, the horizontal axis represents the elevation angle θ (degrees), and the vertical axis represents the gain (dBi). In FIG. 10, a curve 210 (broken line) represents the total gain on the XZ plane, and a curve 211 (solid line) represents the total gain on the YZ plane. Here, the XZ plane is an electrical plane (E plane), and the YZ plane is a magnetic plane (H plane).

As indicated by the curves 210 and 211 in FIG. 10, improved gain is obtained on both the XZ plane and the YZ plane within the range of elevation angles of 0 to ±4 degrees in the antenna device 20.

In FIG. 11, frequency characteristics of a reflection loss (S11) are shown. In FIG. 11, the horizontal axis represents the frequency (GHz) and the vertical axis represents the reflection loss (dB).

As indicated by a curve 212 in FIG. 1, the reflection loss is less than or equal to −10 dB within the range from about 56 GHz to about 64 GHz. Thus, the antenna device 20 has preferable reflection loss characteristics in 60 GHz hand wireless communication applications.

Moreover, the antenna device 20 of the present embodiment is excellent in design work efficiency since it is easy to change the design according to other specifications when an antenna device with different specifications is designed.

For example in a case where the number of patch antennas 1 is modified, as long as the number of patch antennas 1 is $2^N$, the modification can be implemented by increasing/decreasing a T-shaped branch wiring pattern including similar repetitive patterns without newly examining the optimal wiring layout of the feeding conductor.

For example, in the present embodiment, the patch antennas 1 and the radiation elements 1*a* are arrayed in a square lattice and a substantially square lattice, respectively, and the tip lines 6*e* are arranged in a predetermined positional relationship with the respective patch antennas 1 when viewed from the normal direction. Since the line-shaped wiring excluding the tip lines 6*e* is only required to be provided so as to extend in the X-axis direction or the Y-axis direction in an area between adjacent patch antennas 1, no shortage of arrangement space occurs even if the wiring pattern increases.

The line-shaped wiring of the present embodiment has a constant width in the main body, and a predetermined impedance matcher is formed only at an end connected to a branch point, thereby performing impedance matching with a small return loss. Therefore, it is easy to design each piece of the line-shaped wiring, and the antenna can be miniaturized.

As described above, according to the antenna device 20 of the present embodiment, efficient design is enabled with improved gain.

In the description of the above embodiment, the examples of 64 and 4 patch antennas 1 have been described; however, the number of patch antennas 1 is only required to be $2^N$ (where N is an integer greater than or equal to 2) and is not limited to 64 or 4.

In the description of the above embodiment, the example has been described in which four radiation elements 1*a* are arrayed in a rectangular lattice pattern of a substantially square lattice to form a patch antenna 1, and patch antennas 1 are further arrayed in a square lattice pattern.

However, the four radiation elements 1*a* may be arrayed in a rectangular lattice pattern in which array pitches in the first direction and the second direction are significantly different. Similarly, the patch antennas 1 are not limited to a square lattice array, and may be arrayed in a rectangular lattice pattern.

Although the preferred embodiments of the present invention have been described above, the present invention is not limited to these embodiments. Additions, omissions, substitutions, and other modifications can be made within a scope not departing from the spirit of the present invention.

Moreover, the present invention is not limited by the above description, and is limited only by the appended claims.

DESCRIPTION OF THE REFERENCE SYMBOLS

1 Patch antenna
1*a* Radiation element
1*b* Electrode
1*c* Wiring
1*d* Divided circuit pattern
2 First dielectric layer
2*a* First surface (first surface)
2*b* Second surface (second surface)
4 Ground conductor plate
5 Second dielectric layer
60, 106 Feeding conductor
6*b* Impedance matcher
6*c* Second line 6*c* (line-shaped wiring)
6*d* First line 6*d* (line-shaped wiring)
6*e* Tip line (tap)
7 Slot
16*a*, 26*a* First line (line-shaped wiring)
16*b*, 26*b* Second line (line-shaped wiring)
16*c*, 26*c* Third line (line-shaped wiring)
20, 101 Antenna device
36*a* Base end line
P Point (feeding point)

The invention claimed is:

1. An antenna device comprising:
a first dielectric layer;
flat-plate-shaped $2^N$ patch antennas where N is an integer greater than or equal to 2 arranged on a first surface of the first dielectric layer, the patch antennas each comprising an electrode for electromagnetic coupling;
a ground conductor plate arranged on a second surface opposite to the first surface of the first dielectric layer, the ground conductor plate formed with slots, which are non-conductive portions, extending in a first direction at positions facing the electrodes;
a second dielectric layer secured to the ground conductor plate so as to face the first dielectric layer with the ground conductor plate sandwiched therebetween; and
a line-shaped feeding conductor formed on the second dielectric layer so as to face the ground conductor plate with the second dielectric layer sandwiched therebetween, the feeding conductor arranged in a positional relationship intersecting the slots when viewed from a normal direction of the patch antennas with tips extending in a second direction intersecting with the first direction when viewed from the normal direction,
wherein the patch antennas each further comprise:
four radiation elements arrayed in a rectangular lattice pattern at four positions centered at a feeding point in the electrode; and wiring which electrically couples each of the radiation elements and the feeding point with an equal wiring length,
the feeding conductor has
a repetitive branch pattern in which multiple pieces of line-shaped wiring are connected in T-shapes being perpendicular to each other at a total of $2^N-1$ branch points to enable connection from a base end to each of the tips, and
each of the tips is bent in a same direction in the second direction from a terminal end of the line-shaped wiring to which the tip is connected.

2. The antenna device according to claim 1, wherein an impedance matcher
having a line width widened by two or more stages toward a terminal end is provided at an
end of the line-shaped wiring.

3. The antenna device according to claim 2, wherein a change in impedance at
each of the stages of the impedance matcher is less than or equal to 50 Ω.

4. The antenna device according to claim 3,
wherein, among the impedance matchers, an impedance matcher provided at the base end of the feeding conductor has less than or equal to 30Ω of a change in impedance at a widening stage closest to the terminal end of the base end.

5. The antenna device according to claim 1,
wherein the second direction is perpendicular to the first direction, and
the tips of the feeding conductor are perpendicular to the slots when viewed from the normal direction.

* * * * *